US008056785B2

(12) United States Patent
Gosis et al.

(10) Patent No.: US 8,056,785 B2
(45) Date of Patent: Nov. 15, 2011

(54) MOVEABLE FASTENING TOOL HOLDING BRACKET

(75) Inventors: Anatoly Gosis, Palatine, IL (US); Anthony Caringella, Norridge, IL (US); Yury Shkolnikov, Glenview, IL (US); Kyle T. Kestner, Schaumburg, IL (US)

(73) Assignee: Illinois Tool Works Inc., Glenview, IL (US)

( * ) Notice: Subject to any disclaimer, the term of this patent is extended or adjusted under 35 U.S.C. 154(b) by 210 days.

(21) Appl. No.: 12/239,311

(22) Filed: Sep. 26, 2008

(65) Prior Publication Data

US 2009/0095789 A1 Apr. 16, 2009

Related U.S. Application Data

(63) Continuation-in-part of application No. 11/974,655, filed on Oct. 15, 2007.

(51) Int. Cl.
*B25C 7/00* (2006.01)

(52) U.S. Cl. ..... 227/19; 227/140; 227/156

(58) Field of Classification Search ..... 227/110, 227/8, 152, 151, 19, 175.1–182.1, 142, 154, 227/30, 31, 32, 140, 156
See application file for complete search history.

(56) References Cited

U.S. PATENT DOCUMENTS

| | | | | |
|---|---|---|---|---|
| 622,638 | A | 4/1899 | Sandbo | |
| 1,074,800 | A | 10/1913 | King | |
| 2,169,433 | A | 8/1939 | Roy | |
| 2,637,030 | A * | 5/1953 | Wickman et al. | 227/151 |
| 2,797,414 | A * | 7/1957 | Bolster | 227/110 |
| 2,915,754 | A | 12/1959 | Wandel | |
| 2,994,878 | A | 8/1961 | Abrahamsen | |
| 3,018,481 | A * | 1/1962 | Brooks | 227/8 |
| 3,189,341 | A * | 6/1965 | Maurus | 269/153 |
| 3,360,176 | A * | 12/1967 | Gehl et al. | 227/148 |
| 3,670,941 | A * | 6/1972 | Grinnell et al. | 227/8 |
| 3,734,376 | A * | 5/1973 | Abernathy | 227/111 |
| 3,735,908 | A * | 5/1973 | Kinney et al. | 227/67 |
| 3,822,817 | A * | 7/1974 | Umphress | 227/110 |
| 3,880,339 | A | 4/1975 | Bone | |
| 3,883,064 | A * | 5/1975 | Hilgers | 227/120 |
| 4,196,833 | A | 4/1980 | Haytayan | |
| 4,211,353 | A * | 7/1980 | Aunis | 227/156 |
| 4,327,485 | A | 5/1982 | Rix | |
| 4,346,831 | A | 8/1982 | Haytayan | |
| 4,665,916 | A * | 5/1987 | Green | 227/178.1 |

(Continued)

OTHER PUBLICATIONS

Illinois Tool Works, "Paslode: Model T250A-F16; Operating Manual Parts Schematic," Mar. 2006.

(Continued)

*Primary Examiner* — Lindsay Low
(74) *Attorney, Agent, or Firm* — Greer, Burns & Crain, Ltd.; Patty Chidiac; Mark W. Croll

(57) ABSTRACT

A movable holding bracket is provided for attachment to a fastening tool having a nosepiece for driving a fastener, the holding bracket configured for holding overlapping portions of two members to be fastened to one another, the bracket including a fixed portion configured for attachment to a workpiece contact element of the tool, and a movable portion movably attached to said fixed portion. A holding arm is attached to the movable portion and defines a gap configured for holding the overlapping portions of the two members for insertion of a fastener driven from the tool nosepiece.

16 Claims, 15 Drawing Sheets

U.S. PATENT DOCUMENTS 4,674,669 A * 6/1987 Kozyrski et al. ..... 227/147
4,684,050 A 8/1987 Masas
4,736,880 A * 4/1988 Sodeno ..... 227/149
4,767,043 A * 8/1988 Canlas, Jr. ..... 227/8
4,821,937 A * 4/1989 Rafferty ..... 227/8
4,951,532 A 8/1990 Nelson
5,007,573 A 4/1991 Uuskallio
5,201,449 A * 4/1993 Miller ..... 227/8
5,261,587 A 11/1993 Robinson
5,261,588 A * 11/1993 Lin ..... 227/110
5,490,334 A * 2/1996 Payne ..... 33/613
5,509,331 A 4/1996 Nickipuck
5,509,596 A 4/1996 Green et al.
5,520,318 A * 5/1996 Sloop ..... 227/32
5,649,661 A * 7/1997 Masuno et al. ..... 227/8
5,685,473 A 11/1997 Shkolnikov et al.
5,743,455 A 4/1998 Holliday
5,938,099 A * 8/1999 Ciccarelli ..... 227/19
6,024,267 A * 2/2000 Chen ..... 227/8
6,286,742 B1 * 9/2001 Mukoyama ..... 227/8
6,324,743 B1 * 12/2001 Gonnet et al. ..... 29/453
6,393,711 B1 * 5/2002 Freund ..... 33/626
6,454,151 B1 * 9/2002 Wang-Kuan ..... 227/8
6,557,745 B2 * 5/2003 Wang ..... 227/142
6,581,815 B1 * 6/2003 Ho et al. ..... 227/142
6,592,014 B2 7/2003 Smolinski
6,631,836 B2 * 10/2003 Dickhaut ..... 227/148
6,705,501 B2 * 3/2004 Miller et al. ..... 227/8
6,820,789 B2 11/2004 Lipsky et al.
6,824,036 B2 * 11/2004 Walter ..... 227/120
6,896,168 B1 * 5/2005 Logan ..... 227/147
6,988,648 B2 * 1/2006 Taylor et al. ..... 227/142
7,017,790 B1 * 3/2006 Peng ..... 227/119
7,051,914 B2 * 5/2006 Herelier ..... 227/110
7,055,728 B2 * 6/2006 Lin ..... 227/110
7,070,079 B2 * 7/2006 Smolinski et al. ..... 227/8
7,255,256 B2 * 8/2007 McGee et al. ..... 227/8
7,341,172 B2 * 3/2008 Moore et al. ..... 227/8
7,513,404 B2 * 4/2009 Shkolnikov et al. ..... 227/8
7,516,876 B2 * 4/2009 Ohmori ..... 227/119
7,565,992 B2 * 7/2009 Buetow ..... 227/110
7,712,646 B2 * 5/2010 Gamble et al. ..... 227/29
7,721,817 B2 * 5/2010 McGee et al. ..... 173/37
2005/0040207 A1 * 2/2005 Gill ..... 227/154
2006/0016047 A1 * 1/2006 Blackman et al. ..... 16/231
2006/0027978 A1 * 2/2006 Young et al. ..... 279/62
2006/0042425 A1 * 3/2006 Lin ..... 81/177.9
2006/0048366 A1 3/2006 Goodhue et al.
2006/0130276 A1 * 6/2006 Clark ..... 16/299
2007/0215668 A1 * 9/2007 Tabacco et al. ..... 227/107
2008/0110956 A1 * 5/2008 Cho et al. ..... 227/127

OTHER PUBLICATIONS

DeWalt, D51275, 15 Gauge Nailer Users Manual, 2003.

* cited by examiner

MOVEABLE FASTENING TOOL HOLDING BRACKET

PRIORITY CLAIM

This application is a continuation-in-part application of U.S. patent application Ser. No. 11/974,655, filed on Oct. 15, 2007.

FIELD

A field of the invention is holding brackets. An additional field of the invention is fastening tools having holding brackets for holding members to be fastened together. Another field is methods for fastening articles.

BACKGROUND

Fastening tools that use combustion, compressed gas, and other driving forces to shoot fasteners from a barrel and into a work surface are known. Other fastening tools such as power drills and screwdrivers are also known. Such tools can be used, for example, to fasten two members to one another. The two members may be, for example, metal construction framing members such as metal studs and tracks. Metal framing (typically steel) offers advantages compared to wood when used as framing materials related to strength, cost, resistance to shrinkage and warping, resistance to insect damage, resistance to combustion, and others. Metal framing has become very popular for these and other reasons.

Typical metal framing applications often include generally "U"-shaped metal tracks running in the horizontal direction and attached to underlying and overhead substrates which in some cases are concrete floors and ceilings. Vertical studs then connect the upper and lower track members to provide a framing skeleton. Construction panels such as wallboard, paneling or other planar facing material are then attached to this framing structure. The vertical stud may be attached to the horizontal track using a fastener such as a screw, rivet, nail, or the like. The fastener may be inserted using a fastening tool.

SUMMARY

A holding bracket is provided for attachment to a fastening tool, the fastening tool having a barrel for firing a fastener, the tool defining a major axis, the holding bracket for holding overlapping portions of two members to be fastened to one another. An example holding bracket includes a mounting portion configured for attachment to the tool and an extension portion extending from the mounting portion. A holding arm is attached to the extension portion and spaced apart from the mounting portion in the direction of the tool major axis to define a gap between the holding arm and the mounting portion. The gap is configured for holding the overlapping portions of the two members for insertion of a fastener ejected from the barrel.

In another embodiment, a fastening tool is provided for driving a fastener into overlapping portions of a stud and track. An example tool includes a barrel for ejecting a fastener and defining a major axis. The tool further comprises a movable workpiece contact element for engaging a work surface, the tool only able to be fired when the workpiece contact element has engaged a work surface and been moved in a rearward direction parallel to the barrel major axis and into a firing position. The tool further includes a holding bracket having a mounting portion attached to the workpiece contact element, an extension portion extending from the mounting portion in a direction parallel to the barrel major axis, and a holding arm connected to the extension portion. A gap is defined between the holding arm and the mounting portion and dimensioned to receive the overlapping portion of the stud and track therein.

In still another embodiment, a method is provided for fastening a vertical stud to a horizontal track using a fastening tool having a barrel that defines a barrel major axis and has a discharge end through which a fastener is discharged from the barrel, the tool further including a workpiece contact element movable into a firing position. One example method includes the steps of positioning the fastening tool to engage overlapping portions of the stud and track in a gap of a holding bracket attached to the tool, wherein the tool barrel major axis intersects the overlapping portions of the stud and track. The holding bracket includes a mounting portion attached to the movable workpiece contact element, an extension portion extending from the mounting portion, and a holding arm connected to the extension portion and spaced apart from the tool barrel major axis in a radial direction. A gap is defined between the holding arm and the mounting portion and is configured to receive the overlapping portions of the stud and track. The method further includes a step of moving the tool towards the overlapping portions of the stud and track to move the workpiece contact element rearwards along a direction parallel to the barrel major axis into a firing position with the overlapping portions held in the holding bracket gap. A final step includes firing the tool to discharge a fastener from the barrel and through the overlapping portions of the stud and track held in the gap to fasten them to one another.

In yet another embodiment, a movable holding bracket is provided for attachment to a fastening tool having a nosepiece for driving a fastener, the holding bracket configured for holding overlapping portions of two members to be fastened to one another, the bracket including a fixed portion configured for attachment to a workpiece contact element of the tool, and a movable portion movably attached to the fixed portion. A holding arm is attached to the movable portion and defines a gap configured for holding the overlapping portions of the two members for insertion of a fastener driven from the tool nosepiece.

In still another embodiment, a rotatable holding bracket is provided for attachment to a fastening tool having a nosepiece for driving a fastener. The bracket includes a fixed portion configured for attachment to a workpiece contact element of the fastening tool, and a rotatable portion releasably engaged with the fixed portion via a biased locking mechanism. Upon a user overcoming a biasing force generated by the locking mechanism, the rotatable portion is axially disengeable and rotatable relative to the fixed portion, and is lockably reengageable in a new selected location upon reapplication of the biasing force.

In yet another embodiment, a rotatable holding bracket is provided for attachment to a fastening tool having a nosepiece for driving a fastener. The bracket includes a fixed portion configured for attachment to a workpiece contact element of the fastening tool, and a movable portion configured to rotate relative to said fixed portion. A clamping mechanism clamps the movable portion against the fixed portion so that the movable portion is infinitely adjustable relative to the fixed portion.

DETAILED DESCRIPTION

Figure 1:
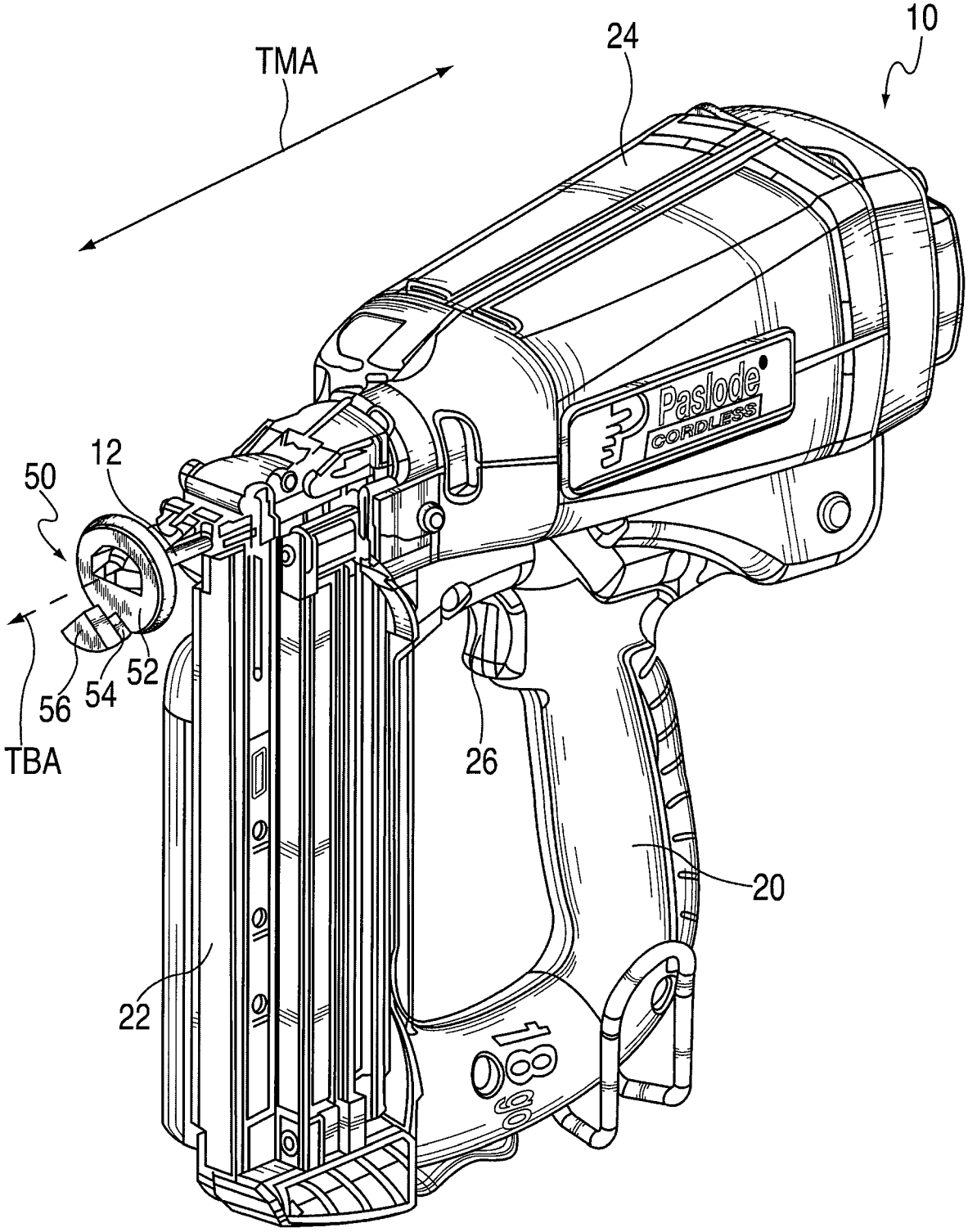
FIG. 1 is a perspective view of the present fastening tool including a holding bracket.

Before illustrating example embodiments of the present holding bracket in detail, it will be appreciated that the embodiments described and illustrated are examples only, and are not intended to limit the scope of the invention. It will also be appreciated that the present invention includes not only articles but methods of using articles as well. For example, one embodiment is directed to a holding bracket for use with a fastening tool. Other embodiments are directed to fastening tools that have a holding bracket and to methods for using fastening tools having a holding bracket to fasten studs to tracks. For purposes of brevity, different embodiments may be illustrated simultaneously below. For example, when discussing an embodiment of the present holding bracket, such discussion may be considered to likewise relate to a fastening tool which includes that holding bracket and to methods for using that bracket and tool.

Turning now to the drawings, FIGS. 1-4 illustrate fastening tools and embodiments of the present holding bracket (and are also useful to illustrate methods of using those tools and brackets to fasten horizontal tracks to vertical studs). A fastening tool shown generally at 10 is a combustion powered nail gun, also known as a combustion nailer. One example tool is a 16 gauge straight framing nail gun or an angled framing nail gun available from ITW Paslode®, Vernon Hills, Ill. Other examples include nail guns available from DeWalt Industrial Tool, Baltimore, Md., including their D51275K 15 gauge angled nailer, D51238K 18 gauge nailer, D1616K electric nailer, and others. Many other fastening tools will be suitable for practice of invention embodiments.

Many aspects of fastening tools including electric, pneumatic and combustion powered guns (with an example being the tool 10) are known in the art and are not necessary for an understanding of embodiments of the present invention. Detailed discussion of these known elements is omitted for the sake of brevity. Additional detail regarding such example elements may be obtained through reference to the following U.S. Pat. Nos. 6,592,014; 5,685,473; and 6,988,648; each of which are incorporated herein by reference.

The tool 10 defines a tool major axis identified as line TMA in FIGS. 1-4. The tool 10 includes a workpiece contact element ("WCE") or actuator bar 12 and a barrel or nosepiece 14 (FIGS. 3-4) extending in the direction of the axis TMA through which a fastener such as a nail is ejected along the tool barrel axis shown as dashed line TBA in FIG. 1 and generally parallel to the TMA.

The WCE 12 is useful to control the firing mechanism of the tool 10. A relevant portion of an example wire frame WCE is shown in isolation in FIG. 5. It includes a generally arcuate engaging end 16 for engaging a work surface that the tool 10 will fire a fastener into. The arcuate engaging end 16 defines a plane that is generally transverse to the tool major axis TMA and barrel axis TBA. The WCE 12 is movable along the direction of the tool major axis TMA so that it can travel along this direction when the tool 10 is brought closer to a work surface that the engaging end 16 has engaged. When the WCE 12 has moved a sufficient distance along the direction of the axis TMA, the tool 10 is in a firing position. The fastening tool 10 is configured so that it is prevented from firing until the WCE 12 is in this firing position. This ensures that the barrel 14 is sufficiently close to a work surface before firing of the tool 10.

Referring again to FIGS. 1-4, the fastening tool 10 further includes a handle 20 for gripping by a user hand, and an elongate track or magazine 22 that is useful for loading fasteners (such as nails) that are held in a fastener cartridge or clip, with one example being a multiplicity of nails arranged in a strip. On the example fastening tool 10, the track 22 extends in a direction generally transverse to the axis TMA. On other example fastening tools, however, the track 22 may extend at other angles relative to the axis TMA, with one example being an orientation of about 30°. The fastening tool 10 has a main body or housing 24 that may enclose elements such as a one or more pistons, a combustion chamber, valving, a motor, gearing, electrical components, a DC power source, and other known components useful for generating and controlling firing forces. A trigger 26 is proximate to the handle and causes the fastening tool 10 to discharge. Driving force can result from a pneumatic, combustion or mechanical event. The driving force impacts the fastener (such as a nail, rivet or the like) and causes it to be shot from the barrel 14 with sufficiently high velocity and force along the tool barrel axis TBA and into the work surface.

Figure 2:
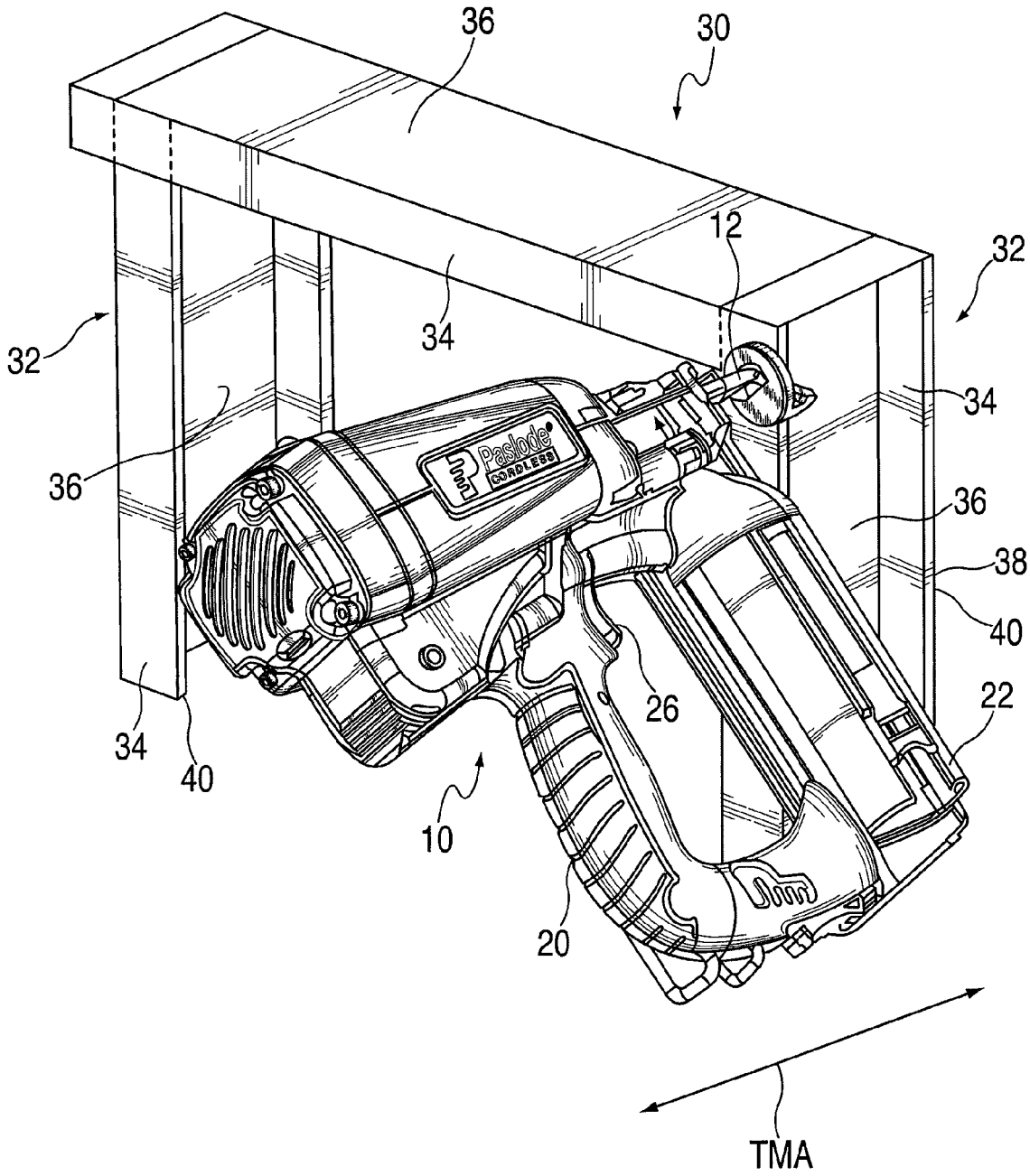
FIG. 2 shows the tool of FIG. 1 with articles held in the holding bracket.
Figure 3:
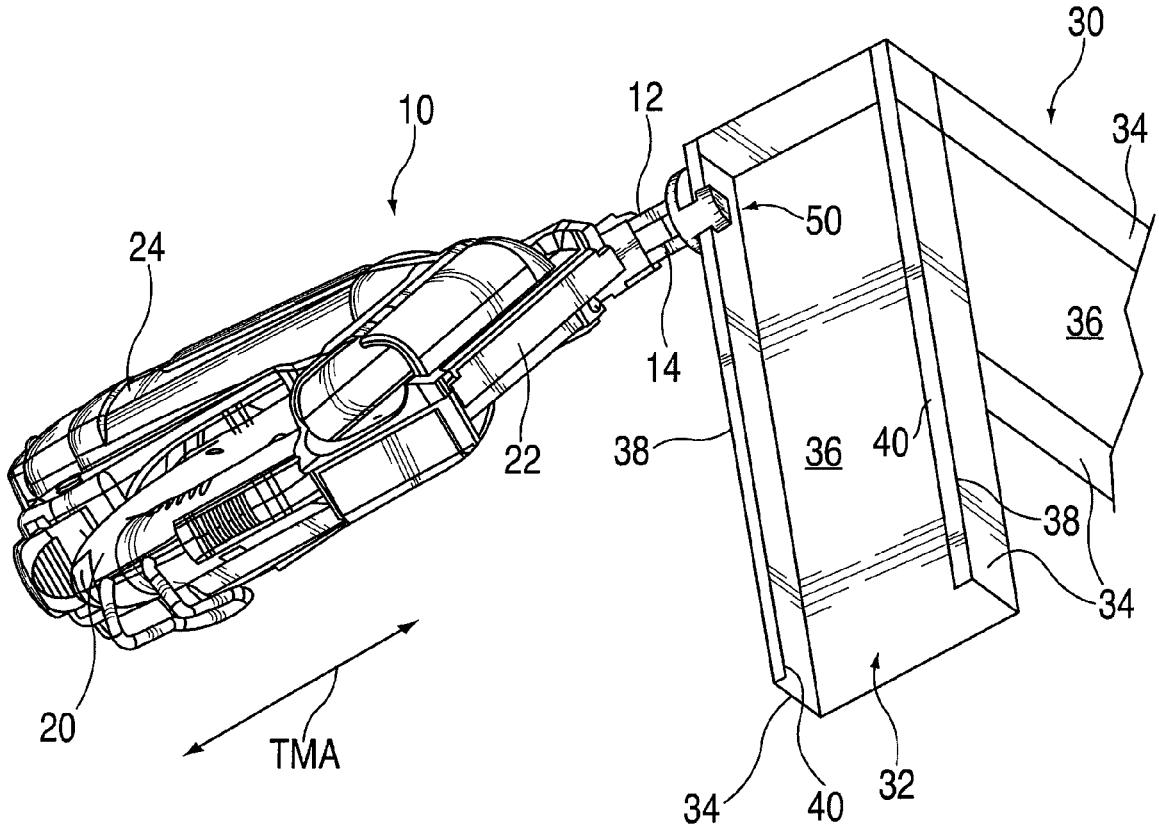
FIG. 3 shows the tool of FIG. 1 with articles held in the holding bracket.
Figure 4:
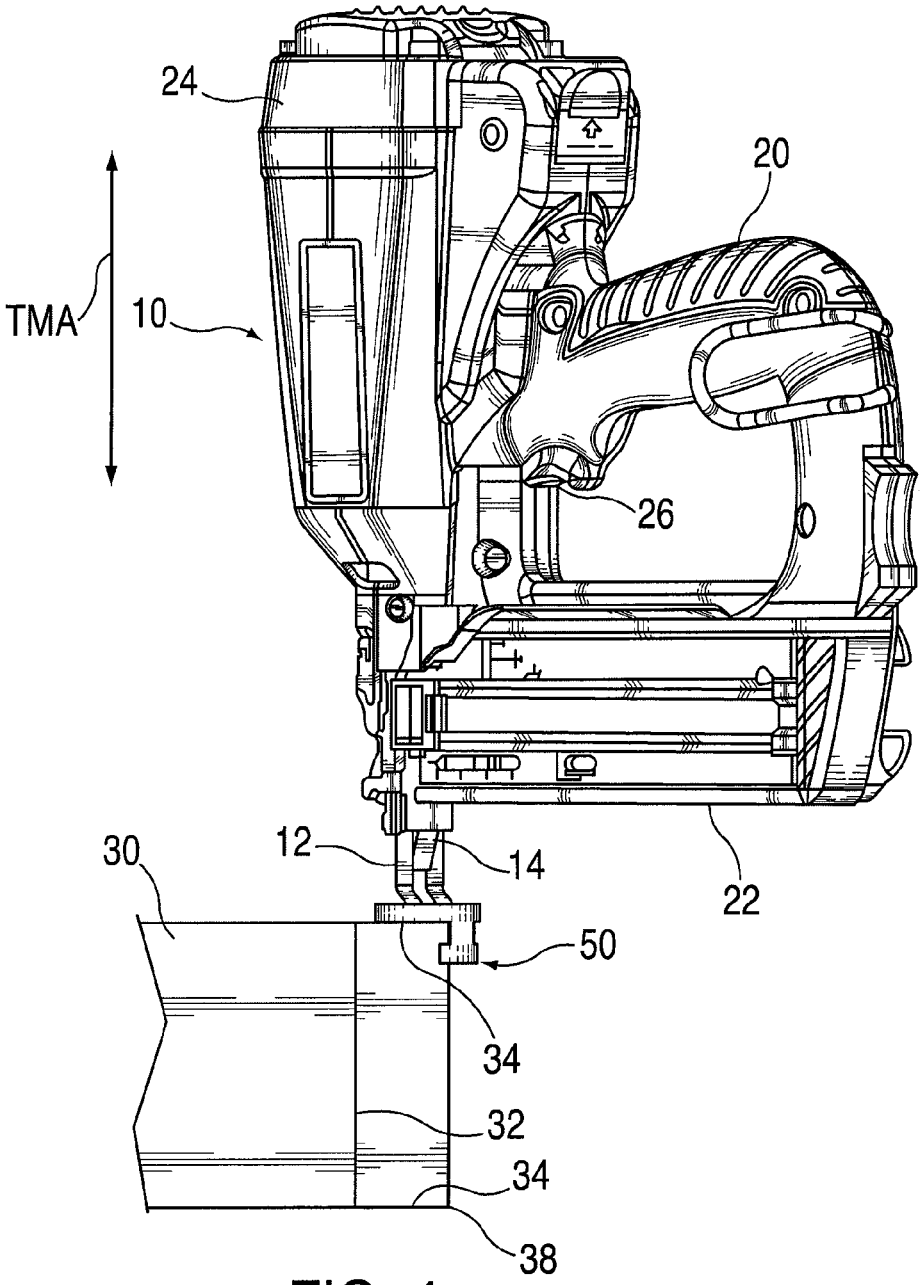
FIG. 4 shows the tool of FIG. 1 with articles held in the holding bracket.

A work surface may be, for example, one of a horizontal track 30 and vertical stud 32 best shown in FIGS. 2-4 that are desired to be fastened to one another. Tracks 30 and studs 32 are known in the art, and may be made of thin metal. Each has a generally "U"-shaped cross-section defined by two opposing sidewalls 34 that rise at an angle of 90° from a planar base 36. As illustrated in FIGS. 2-4, when tracks 30 and studs 32 are attached at right angles to one another portions of their sidewalls 34 overlap. These overlapping portions provide one useful location for inserting a fastener such as a nail, rivet, screw or the like to fasten the track 30 to the stud 32.

The sidewall 34 of the vertical stud 32 further includes a top edge 38 with a small tab or lip 40 (best illustrated in FIGS. 2-3) extending inward towards the opposing sidewall 34 at an angle between about 60° and 90° from the plane of the sidewall 34. The tab 40 is formed of the same metal as the sidewall 34 and the base 36, and is believed to provide the sidewall 34 with additional strength.

Figure 6:
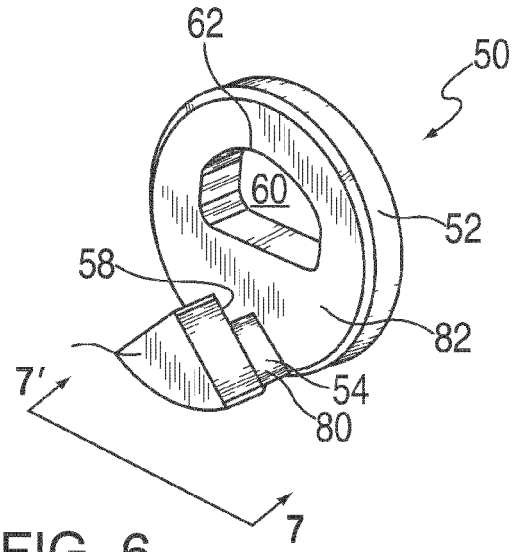
FIG. 6 is a perspective view of the holding bracket of FIG. 1.
Figure 7:
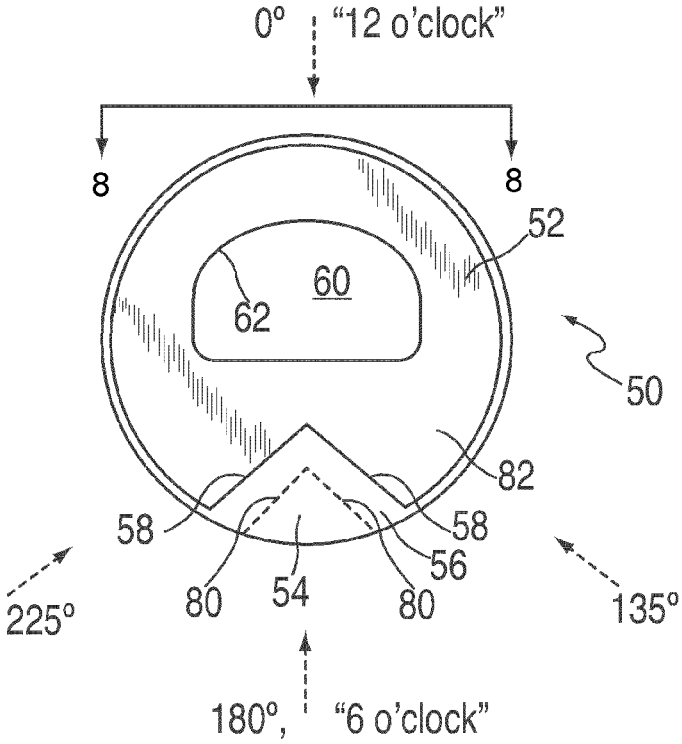
FIG. 7 is a top plan view of the holding bracket of FIG. 6 viewed from the line 7-7 of FIG. 6 and in the direction generally indicated.
Figure 8:
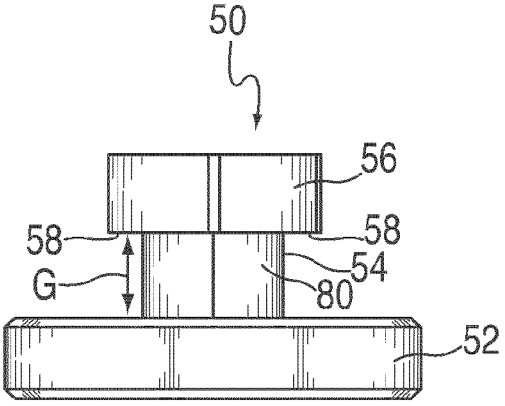
FIG. 8 is a side elevation view of the holding bracket of FIGS. 6 and 7 viewed along the line 8-8 of FIG. 7 in the direction generally indicated.

A holding bracket indicated generally at 50 in FIGS. 1-4 is attached to the tool 10, and is shown in greater detail in FIGS. 6-8. The bracket 50 is useful for holding articles for fastening by the tool 10, with one example being holding a portion of the track 30 and the stud 32. As best shown in FIGS. 6-8, the bracket 50 includes a mounting portion 52, an extension portion 54 and a holding arm 56 connected to the extension portion 54. The mounting portion 52 is generally planar, with the extension portion 54 rising or extending at an angle of about 90° therefrom. The extension portion 54 may be attached to the mounting portion at angles other than 90°, with examples including 45°, 30°, 60°, and others. The bracket 50 may be made of any suitable material, with metals and polymers being two examples. In many applications, the bracket 50 should be relatively rigid and strong. Example materials of construction include aluminum, steel, brass, alloys, and rigid polymers such as ABS and fiber reinforced polymers.

As best shown by FIGS. 6 and 7, the holding arm 56 has a wedge or "pie" shape and defines a plane parallel to a plane of the mounting portion 52. The holding arm 56 includes a pair of shoulders 58 that face the mounting portion 52 and that at least partially define a gap identified by the line G shown in FIG. 8 between the holding arm 56 and the mounting portion 52. The gap G extends in the direction of the tool major axis TMA when the bracket 50 is installed on the tool 10. As best illustrated in FIGS. 2-4, this gap is useful to receive articles such as overlapping portions of respective sidewalls 34 of a track 30 and stud 32, with one or more of the shoulders 58 engaging one of the track 30 or stud 32 and the mounting portion 52 engaging the other. The gap G may have a width in the direction of the axis TMA as desired for a particular application. A width of between about 0.25 and about 0.30 inches has been discovered to be particularly beneficial for applications including fastening metal studs to metal tracks. Other applications may call for other gap dimensions.

Figure 5:
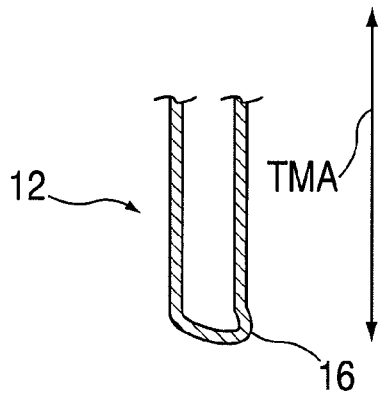
FIG. 5 shows a workpiece contact element in isolation.

As best shown in FIGS. 6-8, the holding bracket 50 further includes a passage 60 extending through the mounting portion 52 in a direction generally transverse to the plane of the mounting portion 52. The passage 60 is configured for attachment to the tool 10 through locking engagement with a portion of the tool 10. Although many different attachment configurations and elements are contemplated, the example holding bracket 50 is configured for attachment to the WCE 12 of the tool 10 (see FIGS. 1-5). The passage 60 is partially defined by an arcuate perimeter sidewall 62 shown in FIGS. 6 and 7 which is configured to engage the arcuate engagement end 16 of the WCE 12 (FIG. 5). The arcuate shape of the passage sidewall 62 is complementary to the arcuate shape of the engagement end 16 for corresponding mating.

The holding bracket 50 can be attached via welding or soldering (if it is made of metal) to the WCE 12, with the wire frame engagement bar 16 welded to the passage 60 arcuate sidewall 62. This provides for firm and permanent attachment. Other example brackets and tools of the invention may include attachment through a compression or snap fit, particularly if the bracket is made of a material such as ABS or similar polymer. In such applications, the mounting portion passage 60 and the arcuate sidewall 62 can be sized and otherwise dimensioned to provide a compression snap fit over the engaging bar 16. To further facilitate such attachment, the perimeter of the passage 60 including the arcuate sidewall 62 can include a concave inner surface shaped to cooperate with the convex shape of the wire frame WCE 12.

Figure 9:
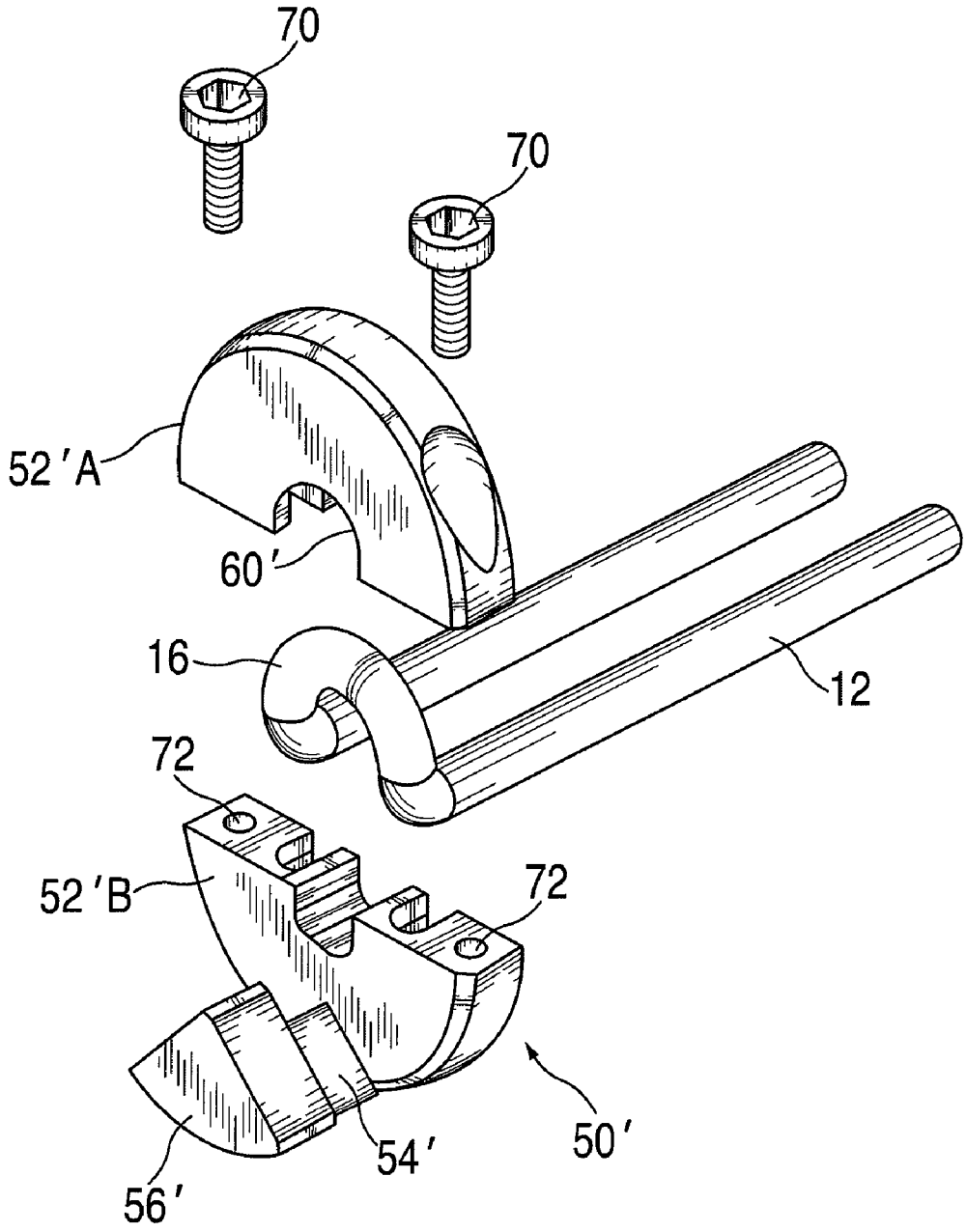
FIG. 9 is an exploded perspective view of an alternate embodiment of the present holding bracket.
Figure 10:
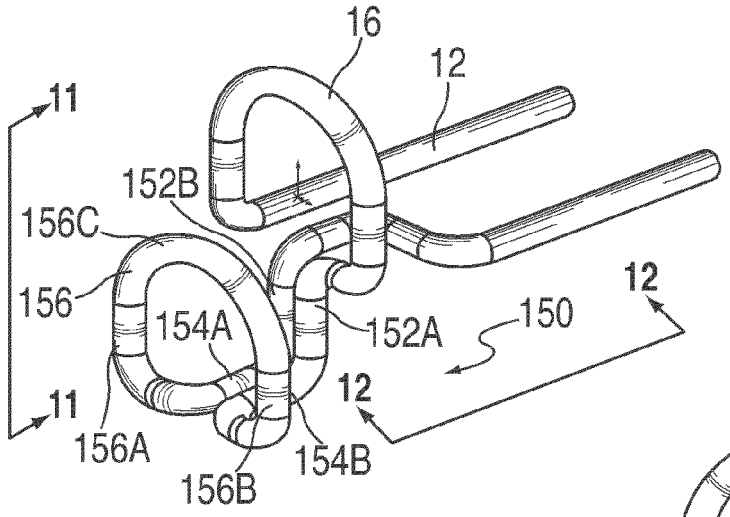
FIG. 10 is a perspective view of yet another alternate embodiment of the present holding bracket.

Other applications may include clamping attachment of a holding bracket to a fastening tool. This can offer benefits related to ease of installation and removal from the tool. One example of a holding bracket of the invention so configured is shown in FIG. 9. Holding bracket 50' is similar in many respects to the example bracket 50 (FIGS. 1-6), with "prime" element numbers used to illustrate similar elements. For example, the holding bracket 50' includes an extension portion 54' that connects a holding arm 56' to a mounting portion of the bracket 50'. The bracket 50', however, differs from the bracket 50 in at least one notable aspect. In particular, the bracket 50' is configured for clamping attachment to the WCE 12.

The mounting portion of the bracket 50' is divided into two separate sections 52'A and 52'B which are lockingly engageable with one another. Each section 52'A and B has a general semicircle shape along the mounting portion plane, and each partially defines the passage 60'. The mounting portion sections 52'A and 52'B include a pair of threaded passages 72 that extend through a portion of both sections 52'A and 52'B in the direction of the mounting portion plane. The passages 72 are threaded to lockingly receive fasteners such as bolts 70 to firmly and removably lock the sections 52'A and 52'B to one another. The two sections 52'A and 52'B can be assembled to one another when the arcuate engaging bar 16 of the WCE 12 is positioned in the passage 60'. Doing so locks the bracket 50' onto the WCE 12. Other clamping mechanisms will be apparent to those knowledgeable in the art. Clamping engagement to other portions of the tool 10 is contemplated, with examples including to other portions of the WCE 12 or to the barrel 14 (FIG. 3).

Referring once again to FIGS. 1-8, because the example holding bracket 50 is attached to the WCE 12, the bracket 50 moves only with the WCE 12 and not necessarily with the tool body 24. That is, when WCE 12 is engaged against a work surface and the tool body 24 is moved towards that surface, the WCE 12 moves relative to the body in a direction along the tool major axis TMA. In other embodiments of the invention, however, a holding bracket may be attached to other portions of the tool 10 including, for instance, to the body 24.

As best shown by FIGS. 6-8, the example extension arm 54 has a general triangular shaped cross section coplanar with the plane of the mounting portion 52 and has two planar sidewalls 80 extending along the length of the gap G (FIG. 8) between the holding arm shoulders 58 and the mounting portion planar surface 82. It has been discovered that these planar extension arm sidewalls 80 in combination with the wedge shape of the holding arm 56 offer unique advantages and benefits in relation to engaging side edges of articles to be held by the holding bracket 50 such as side edges of the tracks 30 and studs 42 (FIGS. 2-4). For example, the wedge shape offers ease of engagement with articles and insertion of those articles into the gap for holding. The planar sidewalls 80 provide a useful engagement surface.

It has also been discovered that placement of the extension portion 54 and the holding arm 58 in particular locations on the mounting portion 52 can likewise offer unique benefits and advantages. Referring to the holding bracket 50 as illustrated in FIGS. 1 and 7 for example, it has been discovered that placing the extension portion 54 at the "6 o'clock" position about the circular perimeter of the holding bracket 50 as oriented when the bracket 50 is installed on the tool 10 is advantageous. That is, when the tool 10 is held in an upright position by a user, the tool major axis TMA is transverse to a vertical plane (and to the plane of the bracket mounting portion 52), and the uppermost portion of the tool is at the 12 o'clock position (which may also be referred to as the 0° position).

In this orientation, the holding bracket extension portion 54 is located lowermost (i.e., 6 o'clock or 180° position) on the bracket 50, and the passage arcuate sidewall 62 is at a 12 o'clock (or 0°) position. This positioning has been discovered to offer unique advantages and benefits in the ability to engage articles at various orientations and positions. This can be further appreciated through consideration of FIGS. 2-4 which show the tool 10 in various orientations relative to a track 30 and stud 32.

Other orientations and placements of the extension arm 54 are contemplated. For example, referencing FIGS. 1 and 7 again, and referring to the 6 o'clock position as being at 180° and the 12 o'clock being at 0° in the vertical plane when the tool 10 is in an upright position with its major axis TMA horizontal, placement of the extension arm 54 anywhere between about 135° and about 225° (shown in FIG. 7) is believed to provide suitably advantageous benefits and results. Other fastening applications may result in other placements being desirable, with specific examples including the 3 (90°), 9 (270°) or 12 o'clock (0°) positions.

When the overlapping portions of the track and stud sidewalls 34 are held in the holding bracket gap G, the holding arm shoulder 58 may engage the sidewall tab 40, with the sidewall top edge 38 engaged against the bracket extension portion flat sidewall 80. This has been discovered to be particularly beneficial since the tab 40 can exert a spring force against the shoulder 58 useful to increase the holding power of the holding bracket 50 and to thereby keep the overlapping portions of the track 30 and stud 32 held therein. It is noted, however, that as used herein the term "hold" as used when describing overlapping portions of the sidewalls 34 being held in the bracket gap G do not necessarily require that any particular portions of the overlapping sidewalls 34 be firmly engaged or even engaged at all with any particular portions of the bracket 50. Such engagement, however, may be useful in some applications and accordingly may be provided for.

The passage 60 in addition to providing a structure for attachment to a fastener tool such as the tool 10 further allows the tool to operate without interference from the bracket 50. This is best illustrated by considering the tool barrel 14 axis TBA shown in FIG. 1 that extends in the same direction as the tool major axis TMA along the length of the barrel 14. A fastener such as a nail exiting the barrel 14 will travel along the axis TBA. The bracket passage 60 is positioned so that the axis TBA is in line with it and passes therethrough. Likewise, the holding arm 56 is spaced some distance away from the axis TBA in a radial direction to the axis TBA to avoid interference with the barrel 14 and/or a fastener exiting the barrel 14.

In addition to the example holding brackets 50 and 50', many other configurations are possible within the scope of the invention. FIGS. 10-13 illustrate one such example that has been identified as holding bracket 150. The bracket 150 is of wire frame construction and is integrally attached to a wire frame WCE 12 (a tool is not shown in FIGS. 10-13, but can be consistent with the tool 10 or any similar fastening tool). It will accordingly be appreciated that the term "attached" when used herein to describe attachment of a bracket to a WCE 12 can (but does not necessarily) include integral attachment that can be achieved, for example, by forming the bracket 150 with and at the same time as the WCE 12.

The holding bracket 150 includes a mounting portion formed from a pair of parallel legs 152A and 152B made of the same wire frame used to form the WCE 12. The legs 152A and 152B define a plane that is generally transverse to the tool major axis TMA (FIG. 1). The mounting portion formed from the legs 152A and 152B is attached to the engaging end 16 of the WCE 12. Two parallel extension portion legs 154A and 154B each extend from the plane defined by mounting portion legs 152A and 152B at an angle of about 90°, and are connected to a holding arm 156. The extension portion legs 154A and 154B are each integrally connected to one each of the mounting portion legs 152A and 152B.

The holding arm 156 is formed of the same metal wire frame as the mounting portion legs 152A and 152B and the extension portion legs 154A and 154B, and in fact is integrally attached to each. All three may be formed from a suitable diameter metal wire which is bent into the desired configuration when at a sufficiently high temperature so as to be pliable. Or, a mold may be used. The holding arm 156 includes generally straight legs 156A and 156B integrally connected to extension portion legs 154A and 154B, and an arcuate leg 156C connecting the two legs 156A and 156B. The holding arm legs 156A, 156B and 156C collectively define an open loop or "D" shape with an open center. The holding arm arcuate leg 156C is configured to be the same size as the actuator arm arcuate engaging end 16, although other sizes are contemplated. The sizing illustrated, however, is believed to provide benefits related to holding power, ease of manufacture, and ease of use.

Figure 11:
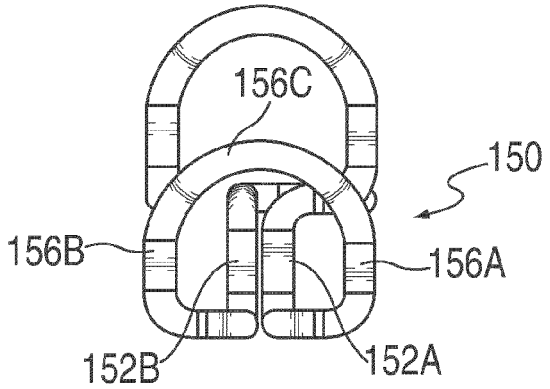
FIG. 11 is a bottom plan view of the holding bracket of FIG. 10 viewed from the line 11-11 of FIG. 10 and in the direction generally indicated.
Figure 12:
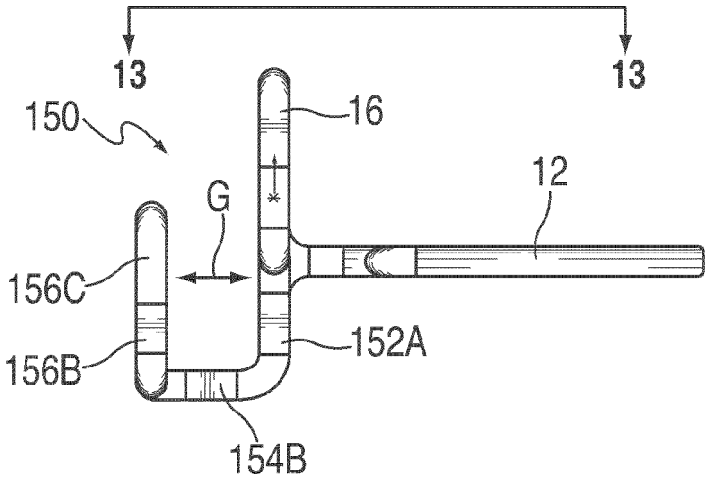
FIG. 12 is a side elevation view of the holding bracket of FIGS. 10 and 11 viewed from the line 12-12 of FIG. 10 in the direction generally indicated.
Figure 13:
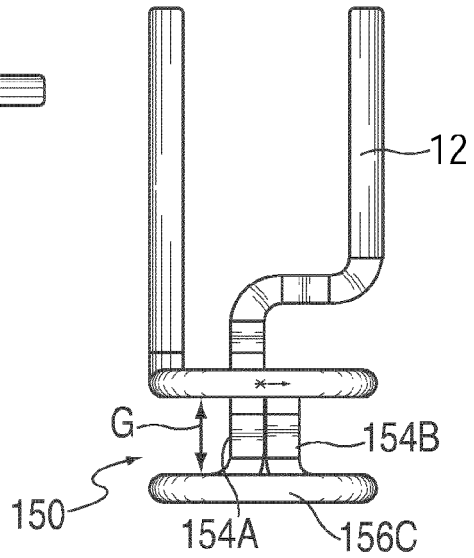
FIG. 13 is a side elevation view of the holding bracket of FIGS. 10-12 viewed from the line 13-13 of FIG. 12 in the direction generally indicated.

As best shown in FIGS. 11 and 12, the holding arm 156 is offset from the WCE engaging end 16 to avoid interference with the firing of a fastener. As best shown by the views of FIGS. 12 and 13, a gap G is defined between the holding arm 156 and the mounting portion legs 152A and 152B. The gap G is dimensioned to hold articles therein for operation on by a tool, with an example being overlapping sidewall portions of the stud 30 and the track 32 (FIGS. 2-4).

Figure 14:
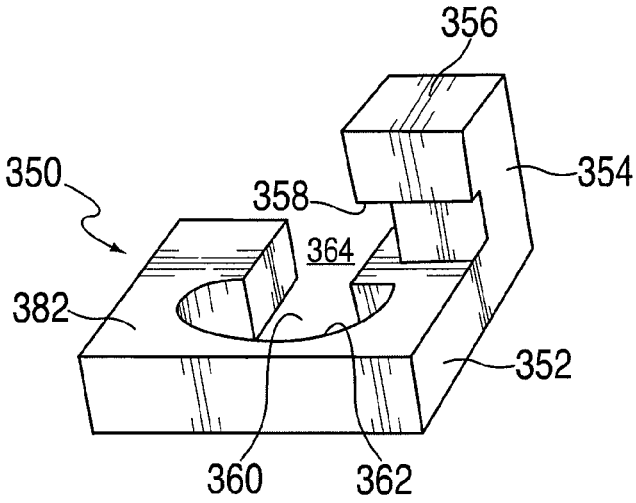
FIG. 14 is a perspective view of still another alternate embodiment of the present holding bracket.
Figure 15:
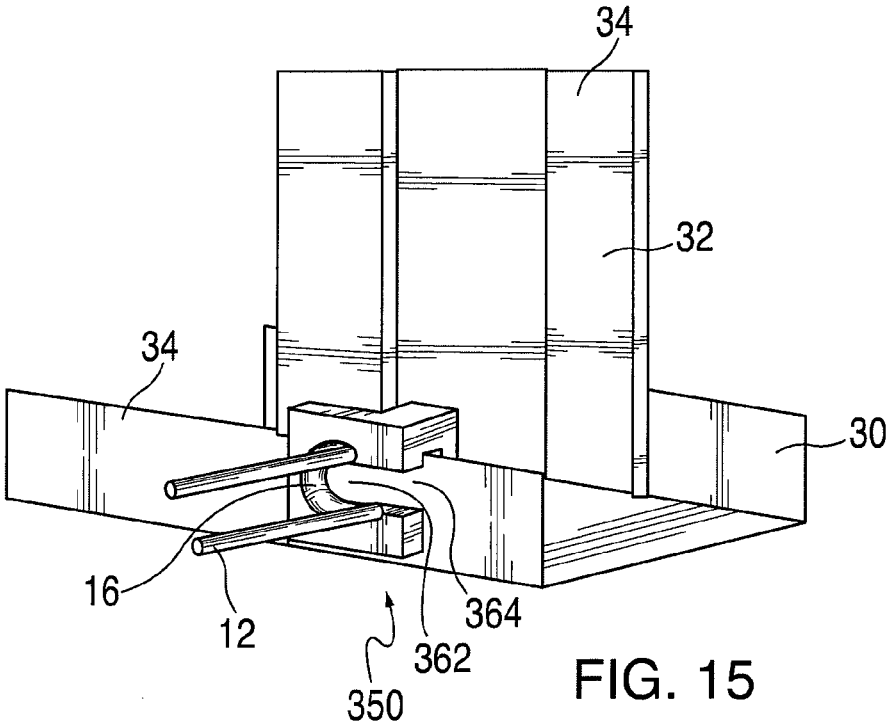
FIG. 15 is a perspective view of the example holding bracket of FIG. 14 installed on a workpiece contact element.
Figure 16:
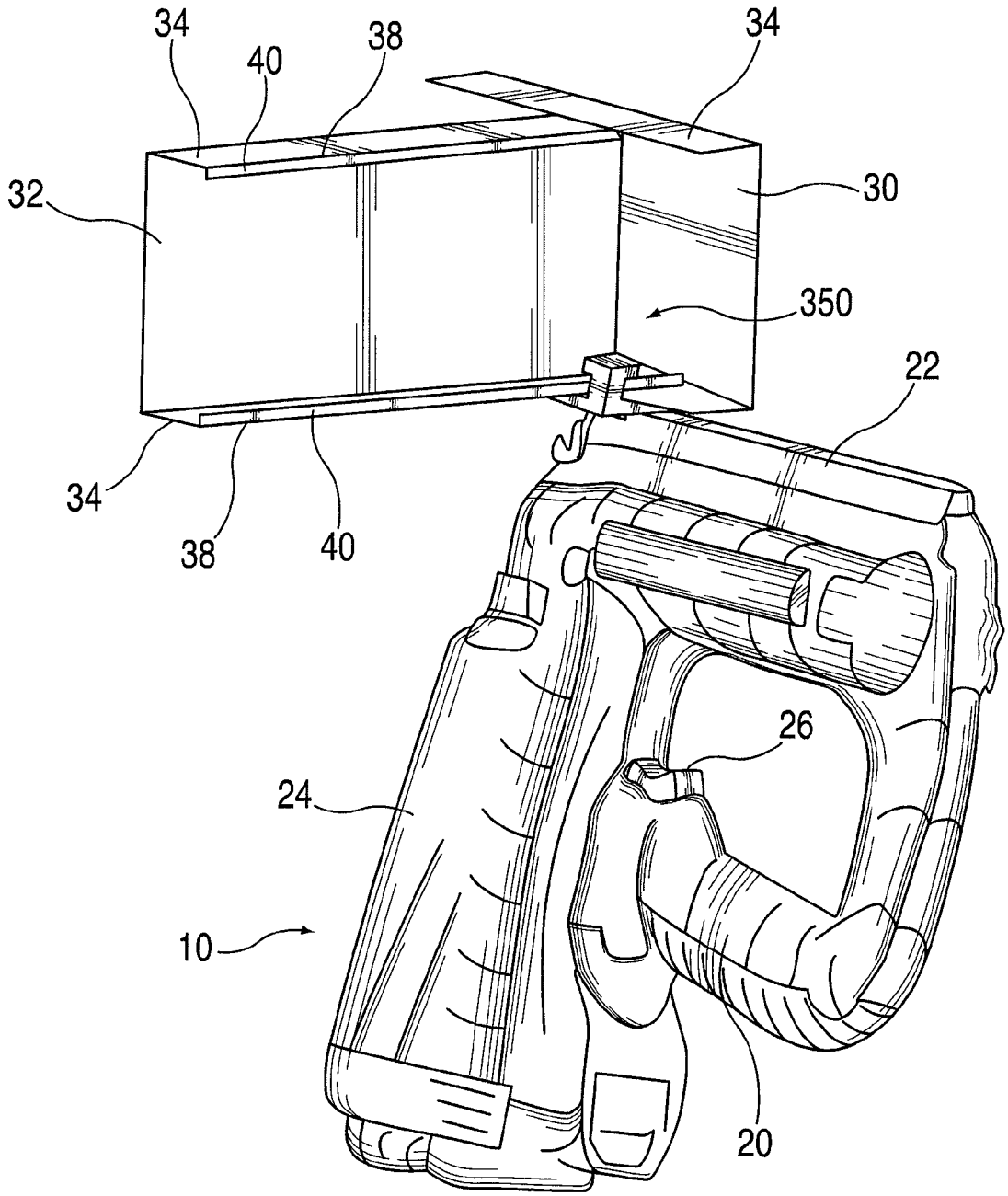
FIG. 16 is a perspective view of the example holding bracket of FIGS. 14-15 installed on a suitable fastener driving tool being used to fasten a stud to a track.

Referring now to FIGS. 14, 15 and 16, an additional holding bracket and fastening tool is illustrated, being generally designated 350. The bracket 350 is consistent in many respects to other brackets illustrated and discussed herein including the bracket 50. For this reason, similar element numbers in the 300 series have been used for clarity. Bracket 350 includes a planar and generally square shaped mounting portion 352. Extension portion 354 rises from a corner of the mounting portion 352 at an angle of about 90 degrees and is connected to a square or block-shaped holding arm 356 which is coplanar with the mounting portion 352. The holding arm 356 has an "L"-shaped shoulder 358 along its plane that faces a top surface 382 of the mounting portion 352. A gap is thus defined between the holding arm shoulder 358 and the mounting portion planar surface 382. The gap is dimensioned to hold articles to be fastened therein with an example including the track 30 and the stud 32.

The mounting portion 352 further includes a passage 360 with an arcuate sidewall 362. An entrance slot 364 in the mounting portion 352 extends from the passage 360 to the outer perimeter of the mounting portion 352 with the result that the passage 360 is open on one side. The entrance slot 364 is configured to receive a portion of the tool 10. In particular, it is configured to receive the tool track or magazine 22 (FIG. 16), which carries a cartridge of fasteners loaded for firing, by the tool 10. FIG. 15 shows, in detail, the holding bracket 350 attached to the WCE 12 (portions of the tool 10 other than the WCE 12 have been omitted from FIG. 15 for clarity of illustration) and holding overlapping portions of the track 30 and the stud 32.

As shown, the WCE arcuate engaging end 16 is matingly received in the passage 360 adjacent to the arcuate sidewall 362. The holding bracket 350 may be welded onto the WCE 12, compression fit, attached using a clamping engagement (similar to that shown for bracket 50' above in FIG. 9), or fit using other means as may be desired. Although not illustrated in FIG. 15, the passage 360 is positioned so that the tool barrel axis TBA (FIG. 1) extends therethrough to avoid interference with the firing of a fastener by the tool 10. Holding arm 356 is spaced apart from the axis TBA for similar reasons.

Figure 17:
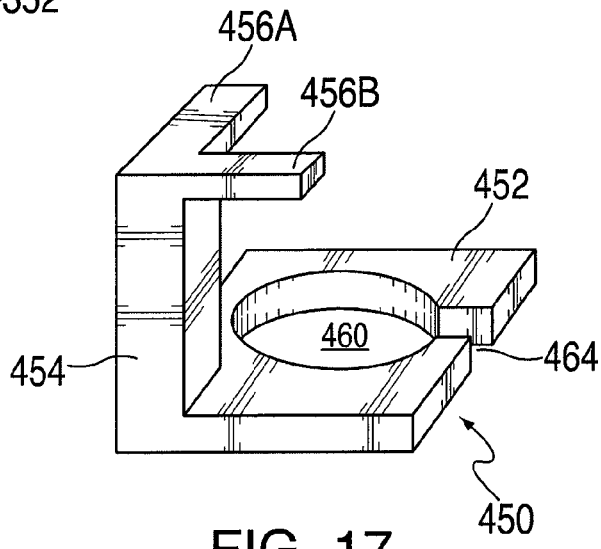
FIG. 17 is a perspective view of a further alternate embodiment of the present holding bracket.

FIG. 17 illustrates yet another example holding clamp, generally designated 450. The clamp 450 includes many elements that are generally consistent with other clamps illustrated herein with like element numbers used in the 400 series for clarity. Thus, the clamp 450 includes a planar mounting portion 452 and an extension 454 connected to the mount portion. Some elements are different, however, with an example being the holding arm which is configured as a pair of arms 456A and 456B in a general "L"-shape and lying along a plane that is coplanar with that of the planar mounting portion 452. Also, the passage 460 has been configured in a generally circular shape with entrance slot 464 provided to accommodate a tool track such as the track 22 (FIG. 16).

Figure 19:
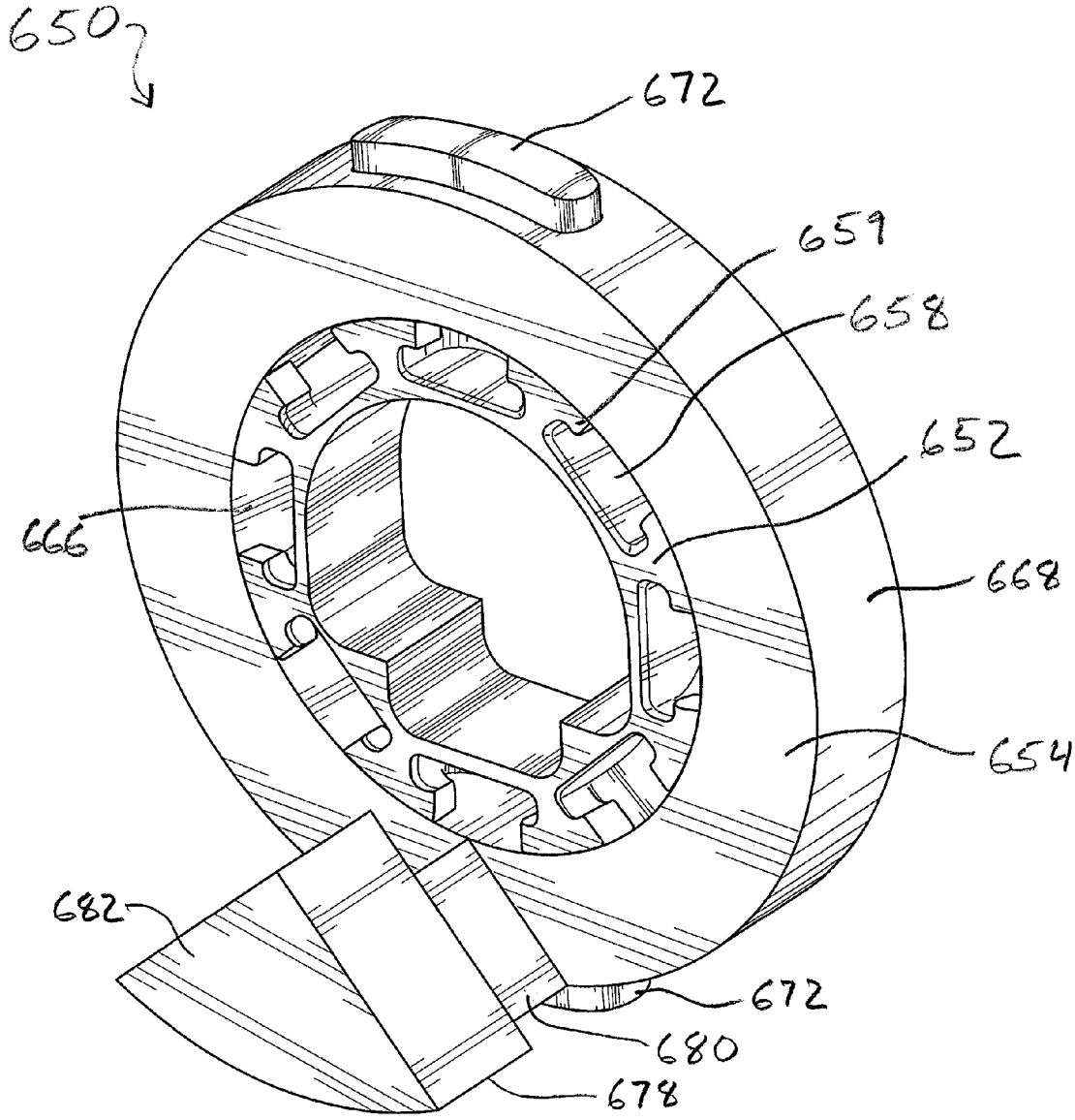
FIG. 19 is a perspective view of an indexable rotatable holding bracket.
Figure 20:
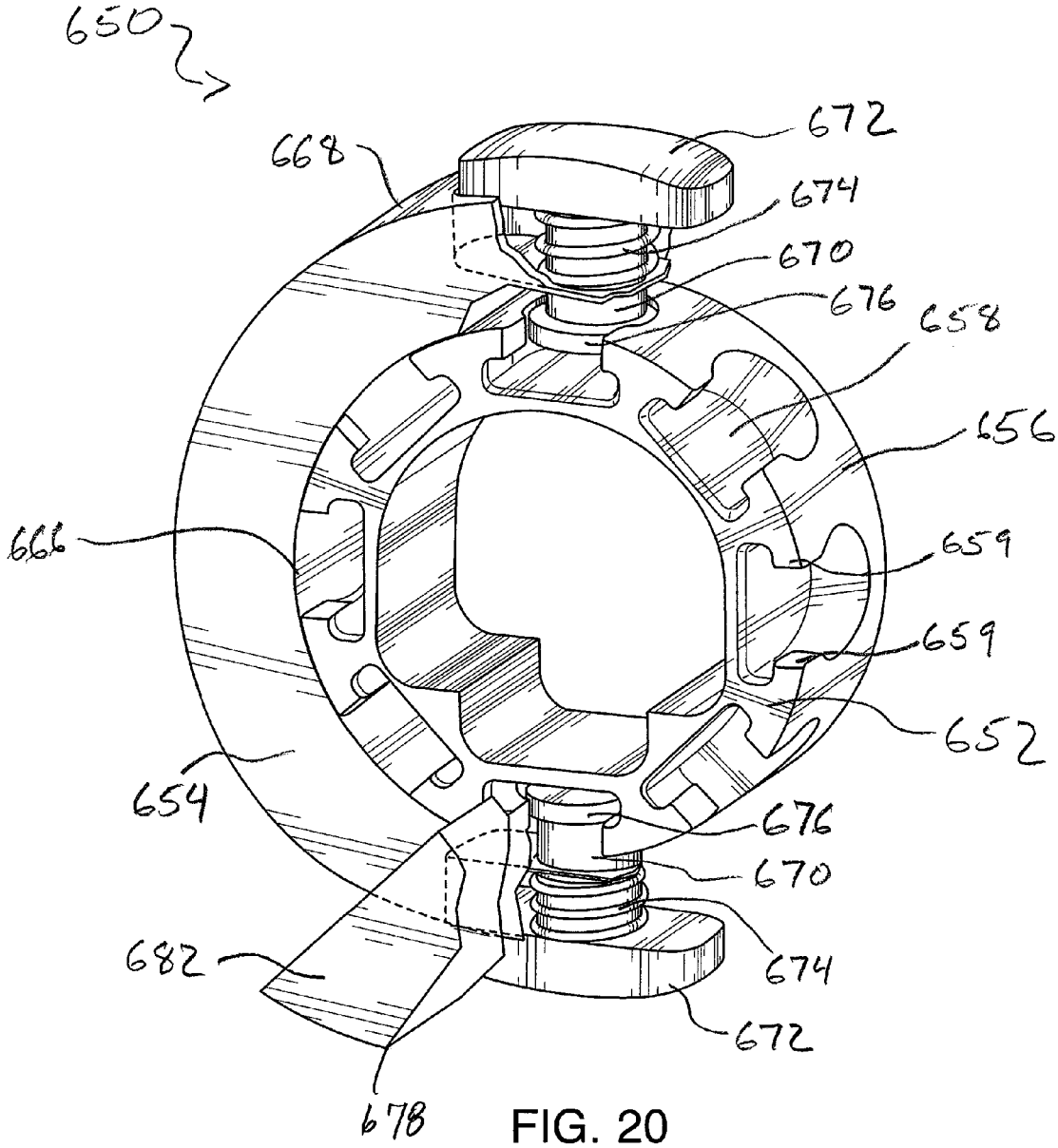
FIG. 20 is a cutaway perspective view of the holding bracket of FIG. 19.
Figure 21:
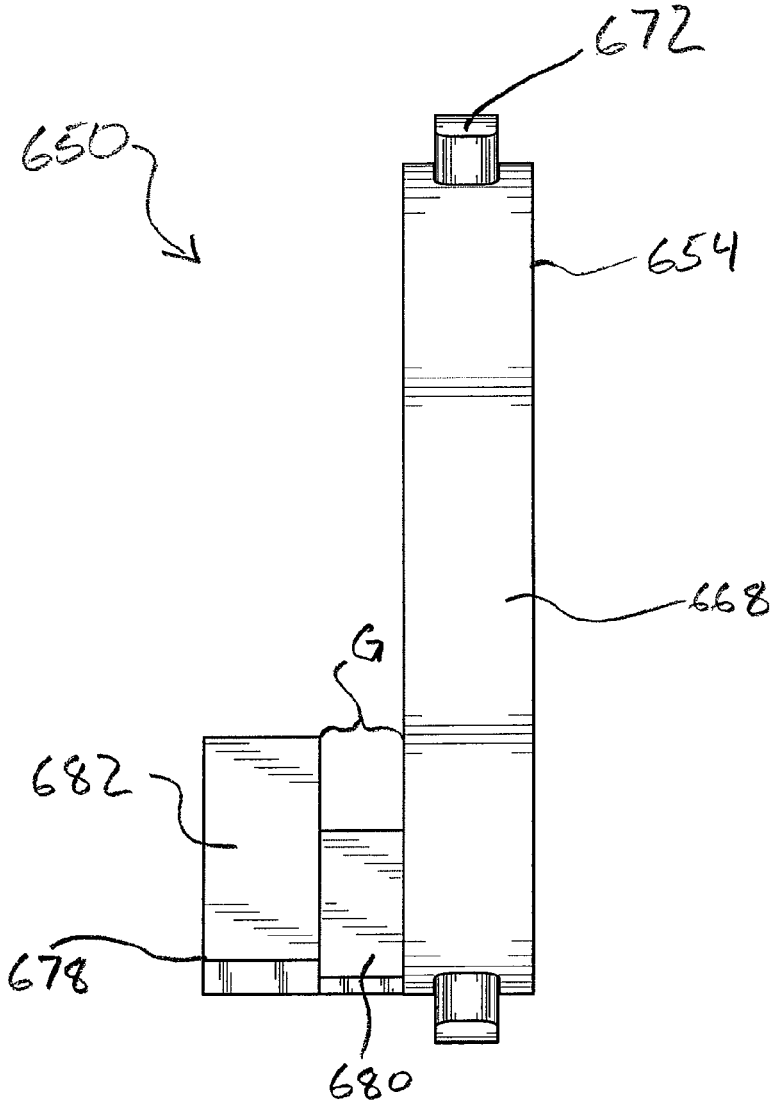
FIG. 21 is a side elevation of the holding bracket of FIGS. 19 and 20.

Referring now to FIGS. 19-21, another example holding bracket is generally designated 650. The bracket 650 includes many elements that are shared with other embodiments, designated in the 600 series for clarity. The holding bracket 650 has a fixed portion 652 and an indexable movable portion 654. The fixed portion is configured to be attached to the WCE 12. The fixed portion may be permanently attached to the WCE 12 by welding or the like as discussed above in other embodiments. Alternatively, the fixed portion 652 may be formed as a part of the WCE 12. It is also contemplated that the fixed portion 652 is clampable onto the WCE 12, as shown in FIG. 9. The indexable portion 654 of the holding bracket 650 is disposable in a plurality of orientations relative to the WCE 12, and is completely removable from the fixed portion 652 to allow for driving fasteners when the user does not require a holding bracket.

The fixed portion 652 is generally annular in shape, and has an outer peripheral edge 656 that removably connects the fixed portion 652 with the movable portion 654. Included on the outer peripheral edge 656 is at least one retaining slot 658. It is also contemplated that the retaining slots 658 are included as one or more diametrically opposed pairs of retaining slots. For example, as shown in the example bracket 650, four pairs of slots 658 are evenly disposed around the outer peripheral edge 656 of the fixed portion 652. Disposed in each slot 658 are one or more lugs 659. It is contemplated that a pair of lugs 659 are symmetrically disposed to project from outer walls into each slot 658, adjacent to the outer peripheral edge 656, so that the slot is generally "T"-shaped when viewed from the top (FIG. 19), and generally "U"-shaped when viewed from the side (FIG. 20). The lugs 659 are thus constructed to reduce the size of the slot 658 from both the top and the side.

Also being annular, the indexable portion 654 has an inner peripheral edge 666 and an outer peripheral edge 668. The inner peripheral edge 666 engages the fixed portion 652 and is sized to fit closely yet slidably around the fixed portion.

One or more studs 670 are disposed on the inner peripheral edge 666 and are each configured to be captured in a corresponding selected retaining slot 658. It is preferred that a diametrically opposed pair of the studs 670 is disposed on the inner peripheral edge 666, to be received by one of the diametrically opposed pairs of retaining slots 658. Each stud 670 is generally cylindrical in shape, is mounted on a button 672 that is accessible from an outer peripheral edge of the indexable portion, and each button is urged radially outward by a spring 674. Each stud 670 includes a radially extending flange 676 on a free end opposite the button 672 that is sized such that it travels freely through the retaining slot 658, but is too large to travel between the lugs 659 disposed in the slot. When viewed from the top, the studs 670 appear generally "T"-shaped.

In operation, a user depresses the button 672 on each of the studs 670, overcoming the force exerted on the button by the spring 674, and allowing the radially extending flange 676 of the stud to disengage from the lugs 659. The user can then slide the studs 670 out from the retaining slots 658 to disengage the indexable portion 654 from the fixed portion 652 along the TMA, which is also the axis of rotation of the indexable portion relative to the fixed portion. Once the indexable portion 654 is removed from the fixed portion 652, the user rotates the indexable portion as desired, such that each stud 670 is aligned with a selected retaining slot 658. The user then inserts each stud 670 into the corresponding retaining slot 658, and releases the buttons 672. When the buttons 672 are released, the springs 674 urge the buttons radially outward, re-engaging the flange 676 with the lugs 659 disposed in the retaining slot 658. The lugs 659 hold the flange 676 in place, effectively locking the position of the indexable portion 654 relative to the fixed portion 652. In this way, the indexable portion 654 is disposable in a plurality of orientations relative to the fixed portion 652.

As is best shown in FIG. 21, a generally "L"-shaped holding arm 678 includes a first leg 680 that is attached to the indexable portion 654 proximate to the outer peripheral edge 668 and a second leg 682 that defines a gap G configured to receive two overlapping members that are to be fastened to one another. The holding arm 678 is positioned on the indexable portion 654 such that the plurality of orientations of the indexable portion with respect to the WCE 12 result in a plurality of orientations of the holding arm, allowing the user to select a holding arm position that allows him to properly orient the fastening tool to the particular fastening application.

Figure 22:
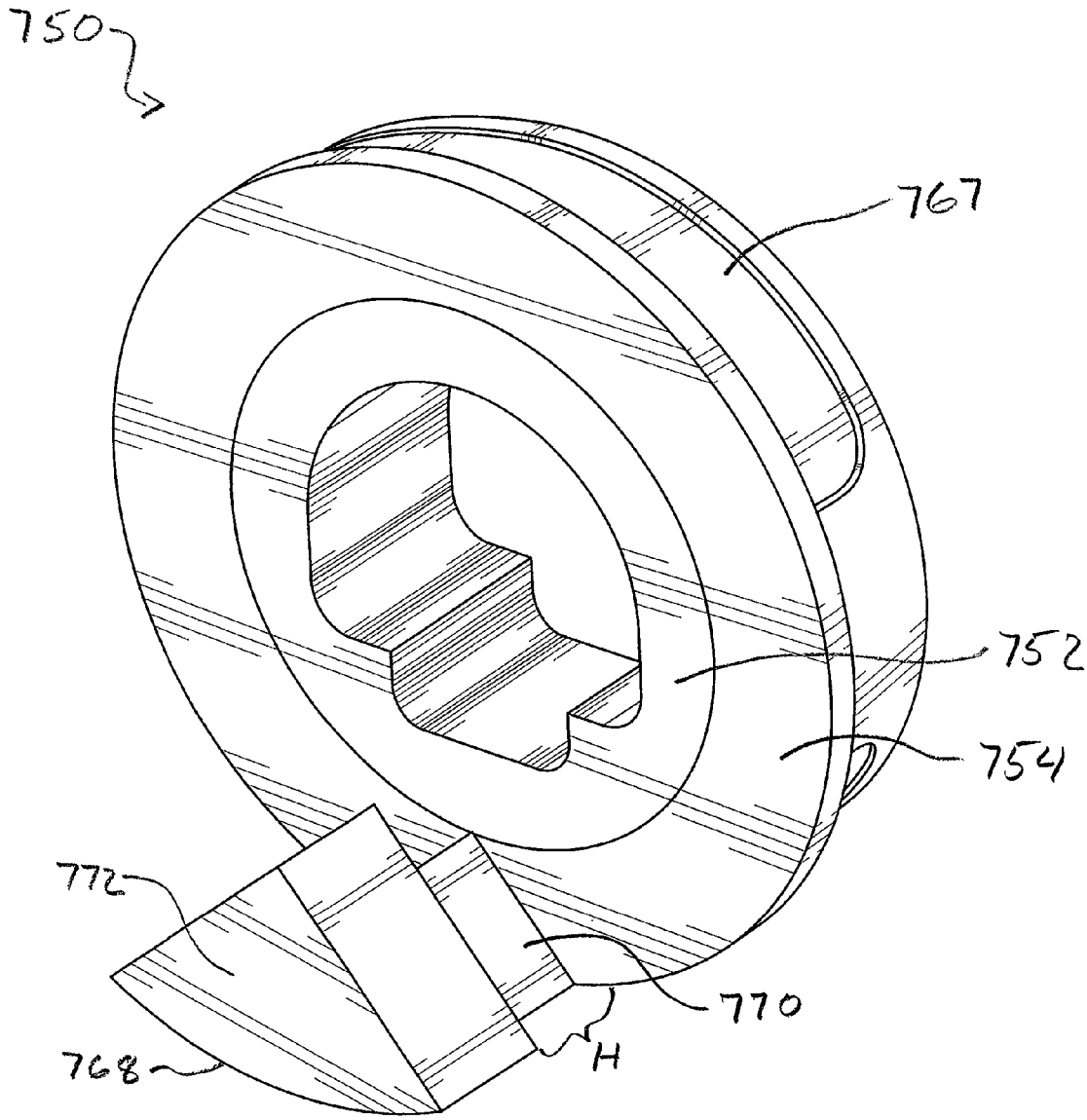
FIG. 22 is a perspective view of an alternate rotatable holding bracket of the bracket of FIGS. 19-21.
Figure 23:
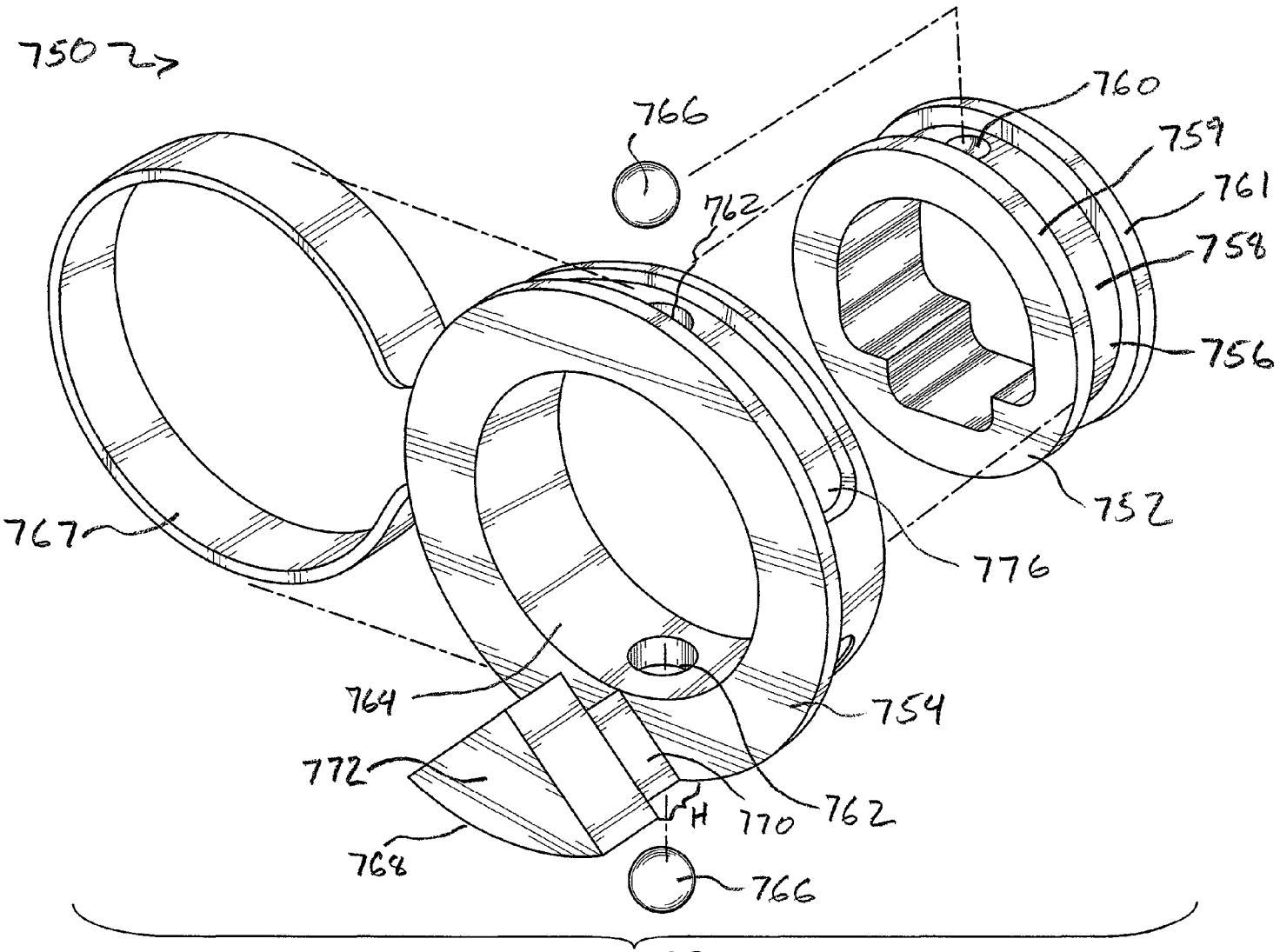
FIG. 23 is an exploded perspective view the rotatable holding bracket of FIG. 22.

Referring now to FIGS. 22 and 23, another embodiment of a holding bracket is generally designated 750, and includes a generally annular fixed portion 752 and a movable or rotatable portion 754. The fixed portion 752 is configured to be attached to the WCE 12 in one of a number of ways, including, but not limited to, being welded or otherwise permanently affixed to the WCE, being formed as a unitary part together with the WCE, and being clamped onto the WCE as shown in FIG. 9. The fixed portion 752 includes an outer peripheral edge 756 that defines a recessed track 758 defined by an upper ring 759 and a lower ring 761, the track running around the periphery of the fixed portion. As an option, the surface of the track 758 includes one or more concave detents 760. The track 758 rotatably engages the rotatable portion 754.

Generally annular in shape, the rotatable portion 754 is sized to fit closely yet rotatably around the fixed portion 752. One or more throughbores 762 are disposed on an inner peripheral edge 764 of the rotatable portion 754. Each throughbore 762 is sized to retain a ball bearing 766, which is secured in place by a "C"-shaped spring clip 767 held in an annular recess 776 in the rotatable portion 754. A clamping assembly is formed by the clip 767 and the ball bearing 766.

Each ball bearing 766 is urged to project partially through the throughbore 762 so that it rolls in the track 758. Thus, the rotatable portion 754 is rotatably secured to the fixed portion 752 by the biased, trapped engagement of the ball bearing 766 in the track 758 and between the upper and lower rings 759, 761. As the rotatable portion 754 is rotated relative to the fixed portion 752 by a user, the user is alerted to a new predefined location by the tactile and/or audible engagement of ball bearing 766 in a selected one of the detents 760. It is contemplated that the tension exerted by the spring clip 767 on the ball bearing 766 is sufficient to maintain any position selected by the user, regardless of whether or not the ball bearing 766 has engaged one of the detents 760, or whether or not the detents are present. That is, the detents 760 serve as a guide for the user, and are not provided to limit the number of possible orientations of the rotatable portion 754 relative the fixed portion 752. Thus, the orientation of rotatable portion 754 relative to the fixed portion 752 is infinitely adjustable. A holding arm 768 defining a gap H is attached to the rotatable portion 754. The holding arm 768 is generally "L"-shaped and includes a first leg 770 that attaches the holding arm 768 to the rotatable portion, and a second leg 772 that defines the gap H, which is configured to hold two overlapping members so that a fastener can be used to hold the members together.

The holding arm 768 is positioned on the rotatable portion 754 such that when a user rotates the rotatable portion about the tool barrel axis TBA, the holding arm is also rotated, allowing the user to select an appropriate orientation.

Figure 18:
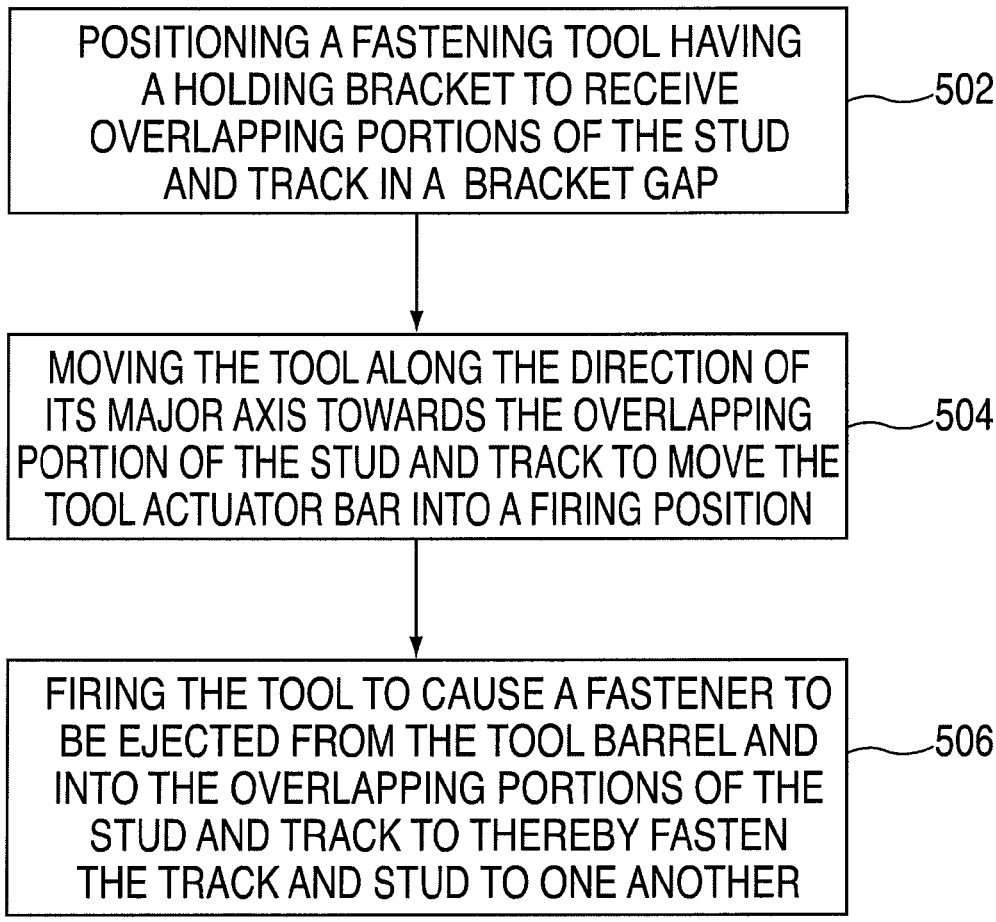
FIG. 18 is a flowchart illustrating the present method for fastening a track to a stud.

In addition to holding brackets and fastening tools having such holding brackets, other embodiments of the invention include methods for attaching a vertical stud to a horizontal track. These methods include steps of using a fastening tool having a holding bracket (such as the bracket 50, 50', 150, 350, 450, 650, or 750) to hold overlapping sidewall 34 portions of a vertical stud 32 and horizontal track 30. FIG. 18 is a flowchart illustrating example steps of one such method. Consideration the above discussion together with the flowchart of FIG. 18 will be useful to best illustrate this method.

In an initial step 502, a fastening tool having a holding bracket is positioned to receive overlapping portions of a vertical stud and horizontal track in a bracket holding gap. The holding bracket may be, for example, any of the brackets 50, 50', 250, 350, 450, 650, or 750 that have been discussed above. Other brackets of the invention may also be used.

In a subsequent step 504 the tool is moved in a direction generally parallel to its major axis towards an overlapping portion of the sidewalls of a stud and track when the tool WCE is engaged on one of the sidewalls. This causes the tool WCE to move into a firing position. This step may be further illustrated by consideration of any of the FIGS. 2-4, or 16. This step may include orienting the tool at a desired angle relative to the track or stud sidewall for fastening. The step may further include rotating the tool relative to the plane of the track or stud sidewall to formally engage the overlapping portions of the stud and track within the holding bracket. The degree of rotation will depend on the application, the holding bracket being used, and like factors. Rotation of from between 20°-90° are examples that will prove useful, as well as any of the tool 10 positions illustrated in FIG. 2, 3, 4 or 16.

However, spatial restrictions at a job site may limit a user's ability to rotate the tool 10 relative to the plane of the track. Accordingly, when using holding bracket 650 or 750, a user may rotate the holding bracket relative to the plane of the track, while holding the tool 10 in any desired position.

The step of rotation may be useful to insert the overlapping portions of the stud and track into a holding bracket gap and to further engage the overlapping portions between a holding arm (such as arm 56—FIGS. 6-8) and a mounting portion (such as portion 52—FIGS. 6-8). This step may further include engaging the top edge 40 of the sidewall 34 (FIGS. 2-4, 16) on a bracket extension portion sidewall (see, for example, FIGS. 2-4 or 16). In a final step 506, the tool is fired to cause a fastener to be ejected from the tool barrel and into the overlapping portions of the stud and track to thereby fasten the track and stud to one another.

It will be appreciated that the example holding brackets, tools having holding brackets, and methods for using such tools and brackets for attaching studs to tracks illustrated and described herein above are examples of the invention only and the present invention is not limited to the structures or steps shown. Many alterations, equivalents and variations are possible within the scope of the invention. It will be appreciated, for example, that the invention is not limited to applications including vertical studs and horizontal tracks only. For example, a stud may be attached to a track at almost any desired angle. Further, the present invention is not limited to fastening tools such as the tool 10. Other examples of fastening tools that the invention may find utility with include other nail guns, cordless screw drivers, electric and cordless drills and the like, as well as other tools. For tools that may apply a torque to a fastener such as a threaded screw, some variations of a holding bracket may be useful to prevent rotation of the articles as a rotational force is applied to them.

Holding brackets, fastener tools and method for fastening track studs of the invention with examples illustrated herein above are useful to achieve valuable advantages and benefits over the prior art. For example, various embodiments of the present invention allow for one handed tool operation by providing a holding bracket which may be useful to hold two articles such as a track and stud to one another. Such operations may have previously required the use of two hands and/or additional tools. Further, it is submitted that various embodiments of the present invention achieve unexpected results. It was unexpected, for example, that the combination of a mounting portion, holding arm and extension arm as configured in any of the example holding brackets would provide the necessary holding power in combination with useful insertion angles to achieve one handed use of a fastening tool.

What is claimed is:

1. A movable holding bracket for attachment to a fastening tool having a nosepiece for driving a fastener, the holding bracket configured for holding overlapping portions of two members to be fastened to one another, and comprising:

a generally annular fixed portion configured for attachment to a workpiece contact element of the tool;

a generally annular movable portion movably attached to said fixed portion; and a holding arm attached to said movable portion, said holding arm including a first leg extending generally perpendicular to said movable portion and a second leg attached to said first leg and extending generally in parallel with said movable portion to define a gap between said movable portion and said second leg, said gap configured for holding the overlapping portions of the two members for insertion of a fastener driven from the tool nosepiece, wherein movement of said movable portion relative to said fixed portion adjusts an axial position of said holding arm without altering a distance between said holding arm and the tool nosepiece.

2. The movable holding bracket of claim 1, wherein said holding arm is L-shaped.

3. The movable holding bracket of claim 1, wherein said fixed portion is attached to the workpiece contact element using a clamping engagement.

4. The movable holding bracket of claim 1, wherein said fixed portion has an outer peripheral edge configured for rotatably engaging said movable portion to move relative to the workpiece contact element.

5. The movable holding bracket of claim 1, wherein said movable portion has an inner peripheral edge and an outer peripheral edge, said inner peripheral edge configured for rotatably engaging said fixed portion, and said holding arm attached to said movable portion proximate to said outer peripheral edge.

6. The movable holding bracket of claim 1, wherein said movable portion comprises at least one throughbore, wherein each said throughbore is configured to retain a ball bearing.

7. The movable holding bracket of claim 6, said fixed portion further comprising:

a track recessed around an outer peripheral edge of said fixed portion, said track configured to rotatably accommodate said ball bearing as said movable portion rotates relative to said fixed portion; and one or more detents disposed on a surface of said track for accommodating said ball bearing.

8. The movable holding bracket of claim 7, further comprising a spring clip at least partially surrounding said rotatable portion, and constructed and arranged for urging said ball bearing into said track.

9. The movable holding bracket of claim 1, wherein said tool has a major axis, said movable portion is indexable relative to said fixed portion as said movable portion rotates relative to said fixed portion about said tool axis.

10. The movable holding bracket of claim 9, wherein said movable portion further comprises at least one stud.

11. The movable holding bracket of claim 10, wherein said fixed portion further comprises at least one retaining slot configured to retain said stud.

12. The movable holding bracket of claim 10, wherein each said stud is attached to said movable portion via a button biased in a radially outward direction relative to said movable portion.

13. The movable holding bracket of claim 12 further including a pair of said studs diametrically opposed to each other on said movable portion, and a plurality of said retaining slots provided in diametrically opposed pairs for selectively accommodating said studs.

14. A rotatable holding bracket for attachment to a fastening tool having a nosepiece for driving a fastener, and comprising:

a fixed portion configured for attachment to a workpiece contact element of the fastening tool, said fixed portion including at least one stud with a radially projecting flange at a free end; and a rotatable portion releasably engaged with said fixed portion via a biased locking mechanism, said rotatable portion including at least one retaining slot configured to releasably retain said stud;

upon a user overcoming a biasing force generated by said locking mechanism, said rotatable portion is axially disengageable and rotatable relative to said fixed portion, and is lockably reengageable in a new selected location upon reapplication of said biasing force, wherein rotating said rotatable portion adjusts an axial position of said rotatable portion relative to said fixed portion without altering a distance between said rotatable portion and the tool nosepiece.

15. The rotatable holding bracket of claim 14, said retaining slot comprising a pair of symmetrically disposed lugs for lockingly engaging said flange, said lugs arranged such that the slot is generally "T"-shaped when viewed from above and generally "U"-shaped when viewed from a side.

16. The movable holding bracket of claim 1, wherein said fixed portion and said movable portion are coaxially aligned.

* * * * *